United States Patent [19]

Pittman

[11] Patent Number: 4,478,036

[45] Date of Patent: Oct. 23, 1984

[54] METHOD, APPARATUS AND INTERMITTENTLY TEXTURED YARN

[75] Inventor: Edgar H. Pittman, Spartanburg, S.C.

[73] Assignee: Milliken Research Corporation, Spartanburg, S.C.

[21] Appl. No.: 468,469

[22] Filed: Feb. 22, 1983

[51] Int. Cl.[3] ..... D02G 1/02; D02G 3/34

[52] U.S. Cl. ..... 57/283; 57/91; 57/284; 57/908; 57/208

[58] Field of Search ..... 57/204–206, 57/208, 243, 245, 246, 90, 91, 282, 283, 284, 287, 288, 264, 332, 333, 334, 336, 352, 908

[56] References Cited

U.S. PATENT DOCUMENTS

| | | | |
|---|---|---|---|
| 2,624,527 | 1/1953 | Von Kohorn | 242/155 |
| 2,705,362 | 4/1955 | Roughsedge | 28/51 |
| 2,724,065 | 11/1955 | Saxl | 310/93 |
| 2,931,090 | 4/1960 | Field, Jr. | 28/1 |
| 2,978,203 | 4/1961 | Westall et al. | 242/155 |
| 2,999,351 | 9/1961 | Davenport et al. | 57/140 |
| 3,009,312 | 11/1961 | Seem et al. | 57/283 |
| 3,022,025 | 2/1962 | Saxl | 242/155 |
| 3,047,932 | 8/1962 | Pittman et al. | 28/1 |
| 3,095,630 | 7/1963 | Pittman | 28/1 |
| 3,106,442 | 10/1963 | Compostella et al. | 18/48 |
| 3,112,600 | 12/1963 | Stoddard et al. | 57/34 |
| 3,113,746 | 12/1963 | Steen | 242/155 |
| 3,152,436 | 10/1964 | Dudzik et al. | 57/157 |
| 3,194,000 | 7/1965 | Eldridge et al. | 57/34 |
| 3,228,181 | 1/1966 | Paterson | 57/283 X |
| 3,352,511 | 11/1967 | Wiggins | 242/155 |
| 3,438,194 | 4/1969 | Cerutti et al. | 57/157 |
| 3,457,715 | 7/1969 | Eldridge et al. | 57/6 |
| 3,606,196 | 9/1971 | Heard | 242/155 M |
| 3,724,409 | 4/1973 | Olney, Jr. | 112/255 |
| 3,782,091 | 1/1974 | Spurgeon | 57/34 HS |
| 3,797,775 | 3/1974 | White | 242/155 M |
| 3,831,880 | 8/1974 | White et al. | 242/156 |
| 3,897,916 | 8/1975 | Rosen | 242/155 M |
| 3,939,632 | 2/1976 | Doschko et al. | 57/283 |
| 4,033,103 | 7/1977 | Vukoje | 57/283 |
| 4,034,548 | 7/1977 | Bueb et al. | 57/288 |
| 4,035,879 | 7/1977 | Schippers | 28/246 |
| 4,346,552 | 8/1982 | Negishi et al. | 57/209 X |

*Primary Examiner*—Donald Watkins

*Attorney, Agent, or Firm*—Earle R. Marden; H. William Petry

[57] ABSTRACT

Method and apparatus to produce a continuous filament textured yarn with unusually low crimp contraction and intermittent crimp and molecular orientation along its length. This is accomplished by the use of an electromagnetic tension device to control the draw in the yarn being supplied to a false twist device driven at a speed to provide low false twist in the yarn being twisted. The apparatus includes a control between the electromagnetic tension control and the yarn supply package to prevent the yarn coming off the package from rotating in a full balloon path and consequently prevent entanglement of the yarn in the yarn guides as it passes to a yarn consuming machine.

12 Claims, 1 Drawing Figure

METHOD, APPARATUS AND INTERMITTENTLY TEXTURED YARN

Figure 1:
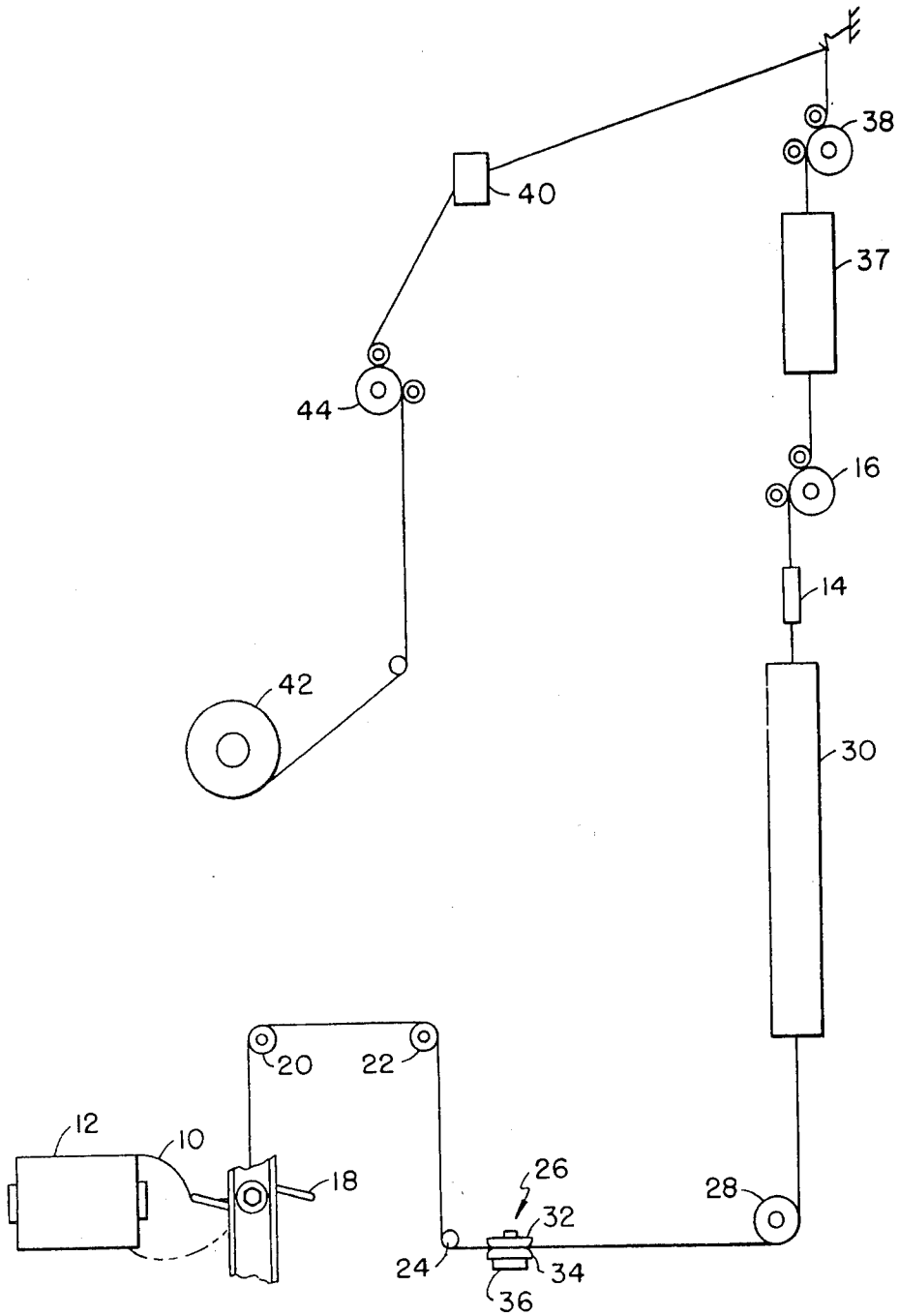

This invention relates generally to the employment of an electromagnetically actuated disc tension control to intermittently grasp and release a continuous filament synthetic yarn which is being processed downstream of the tension control.

It is an object of the invention to provide a yarn processing system which employs a disc tension control to randomly vary the tension of a yarn being processed in a yarn processing machine.

Other objects and advantages of the invention will become readily apparent as the specification proceeds to describe the invention with reference to the accompanying drawings, in which:

FIG. 1 is an overall schematic representation of the new and novel system to produce a textured, continuous filament synthetic yarn.

Looking now to FIG. 1, the overall system of FIG. 1 will be explained. The system is directed to a method to produce a specially textured yarn by intermittently varying the draw of a continuous filament partially oriented, synthetic, multifilament yarn such as polyester. The multifilament yarn 10 is supplied from a supply package 12 to the false twist device 14 by the feed roll device 16. The yarn 10 from the package 12 successively, in its travel to the feed roll device 16, passes through the balloon control apparatus 18, over the guide members 20, 22 and 24 through the electromagnetically controlled tension disc apparatus 26 and under the guide member 28 through the primary heater 30 and false twist device 14 to the feed roll device 16. The yarn 10 is intermittently and randomly drawn in the primary heater 30 by the intermittent hold back action of the disc tension apparatus 26. The discs 32 and 34 are intermittently and randomly drawn together and released on the yarn 10 by the action of the electromagnet 36 controlled by the varying voltage supplied thereto by a suitable voltage source which is varied by the action of a random signal generator such as that shown and disclosed in U.S. Pat. No. 4,160,359.

From the feedroll device 16 the textured yarn passes through the secondary heater 37 with very little overfeed since the speed of the feed roll device 38 is substantially the same as the feed roll device 16 and the crimp in the yarn is allowed to set. Depending on the amount of crimp contraction desired the secondary heater can be either turned on at an appropriate temperature or off or by-passed and the overfeed varied from high to very little.

The feed roll device 38 is driven at a higher speed than the feed roll device 44 to overfeed the textured yarn through the air jet entangling device 40 to commingle and entangle the individual filaments of the textured yarn. From the feed roll device 38 the entangled, textured yarn is fed to the yarn take-up package 42 by the feed roll device 44.

In the form described hereinabove, the preparation of a single end of multifilament synthetic yarn is described but, depending on the ultimate use of the yarn produced, a plurality of yarns can be interlaced or commingled in the air jet 40. Examples of such yarn are set forth below.

EXAMPLE 1

Two ends of a 240 denier, 68 filament DuPont 56T polyester yarn were processed as described above and commingled in the air jet 40 to provide a 2/150/68 yarn with an actual denier of 355. The elongation was 51% with a crimp contraction of 1%. The operating conditions were as follows:

False Twist Spindle Speed—96,000 RPM
Yarn Speed through Spindle—117 yards/minute
False Twist—23 turns/inch
Twist Multiple—306
Direction—"S"
Yarn Overfeed Through Heater 37—By-passed
Yarn Overfeed Through Air Jet—4.0%
Yarn Overfeed to Take-up—1.7%
Temperature of Heater 30—180° C.
Temperature of Heater 37—Off
High Pre-Spindle Tension Average—50 grams
Low Pre-Spindle Tension Average—12 grams The yarn thus produced has a very low crimp contraction with high luster and intermittent character.

EXAMPLE 2

Two ends of a 240 denier, 54 filament DuPont 693T polyester yarn were processed and entangled in the air jet 40 to provide a 2/150/54 yarn with an actual denier of 328. The elongation was 48% with a crimp contraction of 1.8%. The operating conditions were as follows:

False Twist Spindle Speed—129,000 RPM
Yarn Speed through Spindle—127 yards/minute
False Twist—28 turns/inch
Twist Multiple—359
Direction—"S"
Yarn Overfeed through Heater 37—0
Yarn Overfeed through Air Jet—4.0%
Yarn Overfeed to Take-up—1.7%
Temperature of Heater 30—180° C.
Temperature of Heater 37—190° C.
High Pre-Spindle Tension Average—50 grams
Low Pre-Spindle Tension Average—16 grams The yarn produced has a very low crimp contraction with very high luster and intermittent character.

EXAMPLE 3

One end of a 115 denier, 34 filament DuPont 693T polyester yarn was processed and entangled in the air jet 40 to provide a 1/70/34 yarn with an actual denier of 78. The elongation was 34% with a crimp contraction of 0.7%. The operating conditions were as follows:

False Twist Spindle Speed—269,000 RPM
Yarn Speed through Spindle—156 yard/minute
False Twist—48 turns/inch
Twist Multiple—424
Direction—"S"
Yarn Overfeed through Heater 37—5.0%
Yarn Overfeed through Air Jet to Take-up—3.9%
Temperature of Heater 30—180° C.
Temperature of Heater 37—190° C.
High Pre-Spindle Tension Average—35 grams
Low Pre-Spindle Tension Average—15 grams This yarn has a very low crimp contraction, a very high luster, and an intermittent character.

It has been found that the most desirable low crimp, high luster yarn was produced when the twist multiple for the yarn is between 250–450. The twist multiple (TM) is equal to the turns per inch (TPI) of twist imparted to the yarn multiplied by the square root of the yarn denier (YD) ($TM=TPI\times\sqrt{YD}$).

Further tests were run to determine tension limits for both high and low tension requirements to produce an acceptable yarn. These tests were run on 77, 165, and 330 denier polyester multifilament yarn and it was found that the acceptable high tension range was 0.21 to 0.60 grams per denier while the acceptable low tension range was 0.06 to 0.21 grams per denier. These ranges establish tension values which, when operated within, produces an intermittent textured yarn which provides the advantages set forth below.

The described apparatus and method provides a randomly, intermittently textured, continuous multifilament synthetic yarn which along its length has intermittent character consisting of all or part of the characteristics of variable denier (or size or weight/unit length), bulk, torque, twist and shrinkage and dye affinity (or molecular orientation). The produced yarn has a low crimp contraction with a high luster. This yarn is especially useful in the fabrication of a velvet-type upholstery fabric and provides unique visual effects due to its variable character. The yarn of Example 3 is especially useful in the fabrication of woven and knit fabric and provide unique silk-like stria effects, luster, and hand.

Although the preferred embodiment of the invention has been described, it is contemplated that many changes may be made without departing from the scope or spirit of the invention and it is desired that the invention be only limited by the scope of the claims.

I claim:

1. Method to produce a false twisted, continuous multifilament synthetic yarn comprising the steps of: supplying a continuous multifilament yarn from a supply package through a heater to a false twisting device, intermittently and randomly varying the supply of yarn to the false twisting device, driving the false twist device at a speed to produce a twist multiple between 250 and 450 in the multifilament yarn, allowing the yarn to be set after false twisting and taking up the false twisted yarn.

2. The method of claim 1 wherein the false twisted yarn is entangled in an air entanglement device prior to take-up.

3. Apparatus to produce a false twisted multifilament yarn comprising: yarn creel means, a false twist device, a heater means located between said yarn creel and said false twist device, a disc type tension means located between said heater means and said yarn creel means to intermittently and randomly vary the flow of yarn from said creel means to said false twist device, a first means to supply yarn from said yarn creel means to said false twist device, a second means to cause said tension means to randomly vary the supply of yarn to the false twisting device, driving the false twist device at a speed to produce a twist multiple of between 250 and 450 in the multifilament yarn, and a third means to supply false twisted yarn from said false twist device to a take-up means to take-up the false twisted yarn.

4. The apparatus of claim 3 wherein an air jet commingling means is located between said third means and the take-up means to commingle the filaments of the yarn false twisted in said false twist device.

5. Method to produce a false twisted, multifilament synthetic yarn comprising the steps of: supplying a nominal 70 denier continuous multifilament yarn from a supply package through a heater to a false twisting device, intermittently and randomly varying the tension of the yarn in the heater between a high range of 0.21 to 0.60 grams per denier and a low range of 0.06 to 0.21 grams per denier, driving the false twist device at a speed to produce a false twist in the multifilment yarn, allowing the yarn to set after false twisting and taking up the false twisted yarn.

6. The method of claim 5 wherein the false twisted yarn is entangled in an air entanglement device prior to take-up.

7. The method of claim 5 wherein the false twist device is driven at a speed to produce a twist multiple in the yarn between 250 and 450.

8. The method of claim 7 wherein the false twisted yarn is entangled in an air entanglement device prior to take-up.

9. The yarn produced by the method of claim 1.

10. The yarn produced by the method of claim 5.

11. The method of claim 1 wherein the supply of yarn is varied by varying the tension of the yarn in the heater between a high range of 0.21 to 0.60 grams per denier and a low range of 0.6 to 0.21 grams per denier.

12. The yarn produced by the method of claim 11.

* * * * *